US005470262A

United States Patent [19]

Bustillo, Sr.

[11] Patent Number: 5,470,262

[45] Date of Patent: Nov. 28, 1995

[54] PROPELLER ENCLOSURE

[75] Inventor: Pedro Bustillo, Sr., Carolina, Puerto Rico

[73] Assignee: Bustillo Investment Corp., Santurce, Puerto Rico

[21] Appl. No.: 251,904

[22] Filed: Jun. 1, 1994

[51] Int. Cl.[6] ..... B63H 5/16

[52] U.S. Cl. ..... 440/72; 440/67

[58] Field of Search ..... 440/67, 71, 72; 416/247 A

[56] References Cited

U.S. PATENT DOCUMENTS

| | | | |
|---|---|---|---|
| D. 257,353 | 10/1980 | Fogolin . | |
| D. 322,256 | 12/1991 | Reeves . | |
| 3,035,538 | 5/1962 | Willard | 440/72 |
| 4,680,017 | 7/1987 | Eller | 440/72 |
| 4,694,645 | 9/1987 | Flyborg et al. | 440/67 |
| 4,957,459 | 9/1990 | Snyder | 440/72 |
| 5,145,428 | 9/1992 | Harrison | 440/67 |

FOREIGN PATENT DOCUMENTS

| | | |
|---|---|---|
| 59787 | 8/1938 | Norway . |
| 2152459 | 8/1985 | United Kingdom . |
| 2213788 | 8/1989 | United Kingdom . |

*Primary Examiner*—Jesus D. Sotelo
*Attorney, Agent, or Firm*—McAulay Fisher Nissen Goldberg & Kiel

[57] ABSTRACT

The present invention relates to a propeller enclosure for enclosing a skeg and propeller. The invention includes a fence portion which defines a first chamber. The first chamber is designed for receiving the skeg of a watercraft motor. The fence portion allows the passage of water therethrough. The invention also includes a solid band portion which defines a second chamber. The second chamber receives the propeller. A first end of the solid band portion is attached to the fence portion. So that the first chamber communicates with the second chamber. The invention also includes a cover which is mounted on a second end of the band portion. The cover allows the passage of water therethrough. The cover includes means for causing trim-tab-like action. The propeller enclosure of the present invention is intended for mounting to a cavitation plate.

3 Claims, 7 Drawing Sheets

PROPELLER ENCLOSURE

BACKGROUND OF THE INVENTION

This invention relates in general to a propeller enclosure arrangement for use with motors employing a propeller. More specifically, this invention relates to a propeller enclosure arrangement for outboard watercraft motors.

In recent years, a number of medical studies have been performed examining the extent and seriousness of injuries resulting from watercraft propellers. The injuries resulting from contact with watercraft propellers, if not fatal, are usually severe and disfiguring. The injuries often lead to prolonged disability and permanent impairment. Medical treatment for such injuries include costly medical, surgical and rehabilitative services.

The injuries resulting from contact with watercraft propellers are most commonly suffered by water skiers. This is foreseeable in light of the need for the water skier to jump from the boat in order to be placed in the water to ski, as well as, the need for the boat to circle the skier to allow him to retrieve the toe rope.

In addition to the injuries suffered by human beings, recent studies have also indicated significant mortality rates of marine life, including dolphins and manatee due to contact with watercraft propellers.

Exposed watercraft propellers are also susceptible to damage as a result of contact with rocks, coral, etc. The likelihood of propeller damage is increased substantially in shallow water. Often times, the cost to repair or replace a propeller is substantial.

The need to provide protection both from and to watercraft propellers is evident.

Propeller guards have been developed in the past. The guards which have been developed, however, result in reduced power output from the motors with which they are associated. Accordingly, the use of such guards by boat owners, especially those seeking to obtain the maximum thrust from their boat motors (including water skiers), has been less than desirable.

An objective of this invention, therefore, is to provide a propeller guard which protects human beings and marine life, without sacrificing watercraft motor thrust. A related objective of this invention is to provide a propeller guard which protects the propeller from damage resulting from contact with unintended objects, without sacrificing the thrust delivered by the motor associated with the propeller.

BRIEF DESCRIPTION

The present invention relates to a propeller enclosure for enclosing a skeg and propeller. The enclosure includes a fence portion which receives the skeg of a watercraft motor. The fence portion allows the passage of water therethrough. The enclosure also includes a solid band portion which receives the propeller. A first edge of the solid band portion is attached to the fence portion. The enclosure also includes a cover which is mounted to a second edge of the band portion. The cover has openings to allow the passage of water therethrough. The cover includes horizontal slots for causing trim-tab-like action. The propeller enclosure of the present invention is intended for mounting to a cavitation plate.

BRIEF DESCRIPTION OF THE DRAWINGS

FIG. 5 illustrates the mounting of the propeller guard and rear cover arrangement onto a watercraft motor with the watercraft motor skeg and propeller positioned within the propeller guard arrangement.

PREFERRED EMBODIMENTS OF THE INVENTION

Figure 1:
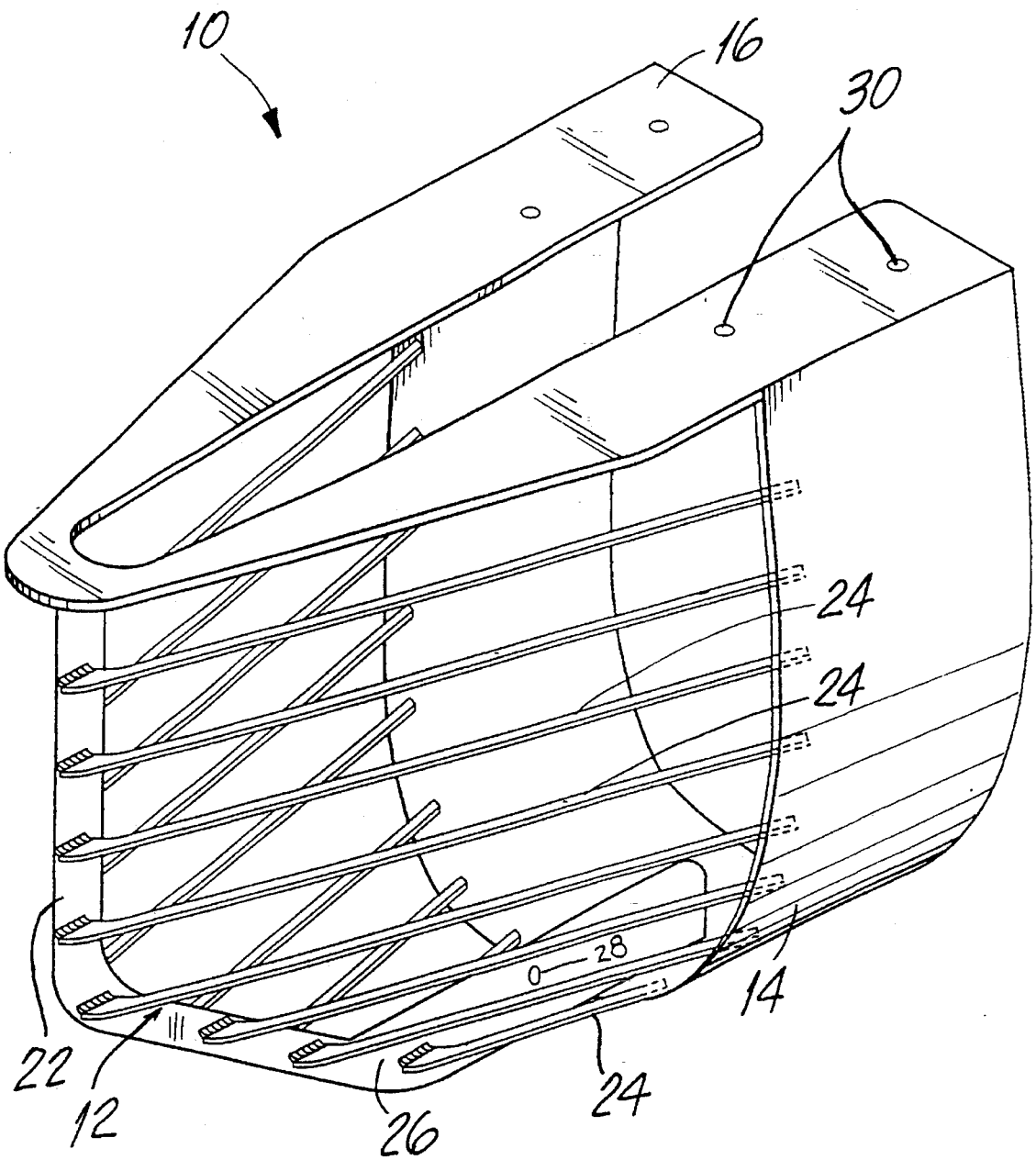
FIG. 1 is a perspective view of a propeller guard enclosure according to the present invention.
Figure 2:
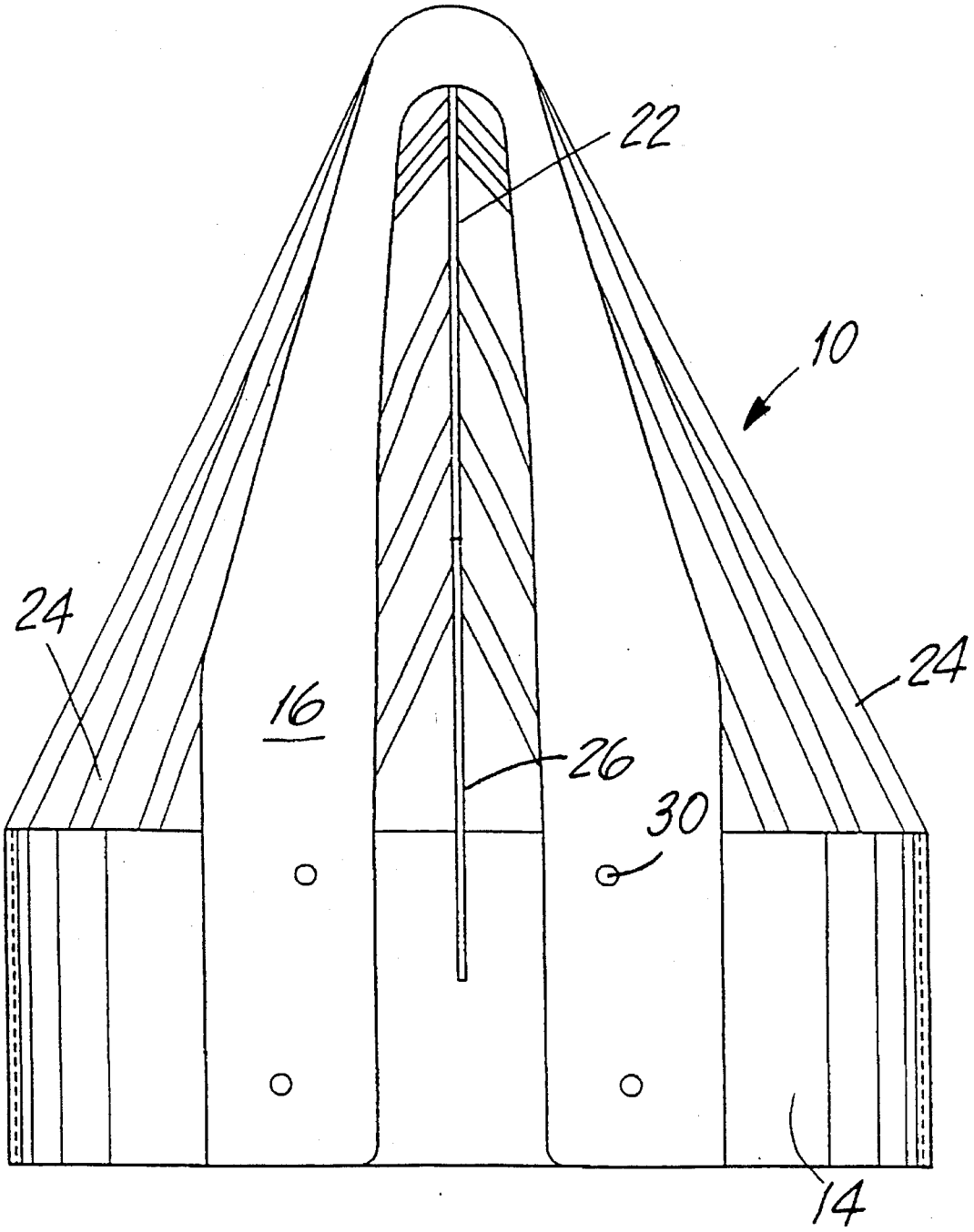
FIG. 2 is a top plan view of the embodiment illustrated in FIG. 1.
Figure 3:
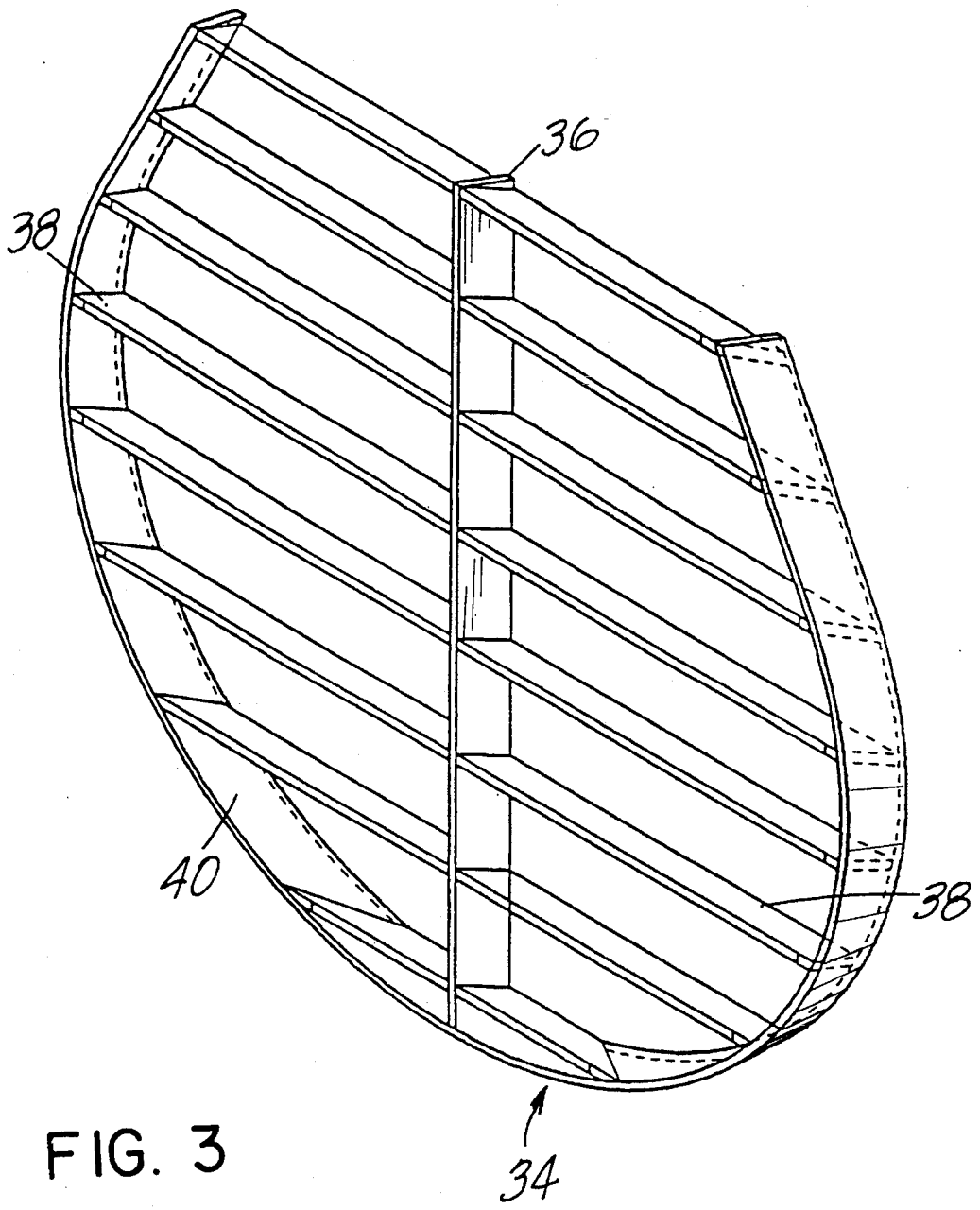
FIG. 3 is a perspective view of a rear cover for use with the propeller enclosure illustrated in FIGS. 1 and 2.
Figure 4:
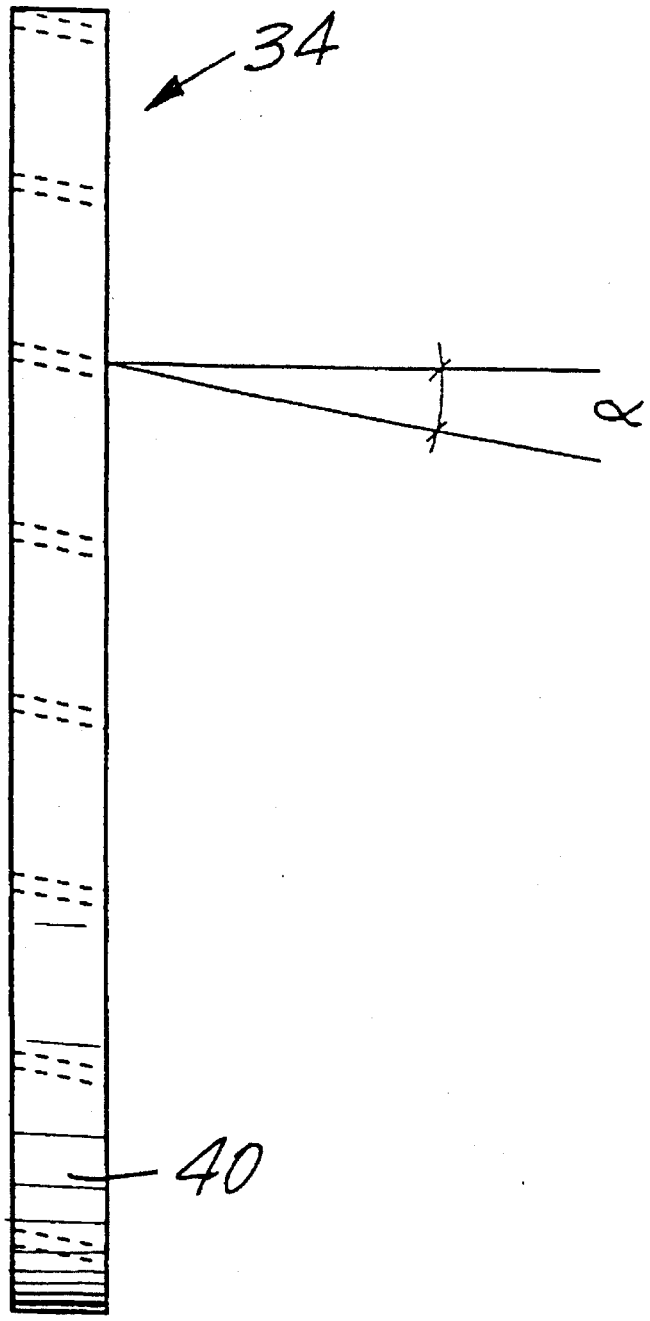
FIG. 4 is a side plan view of the rear cover illustrated in FIG. 3.
Figure 5:
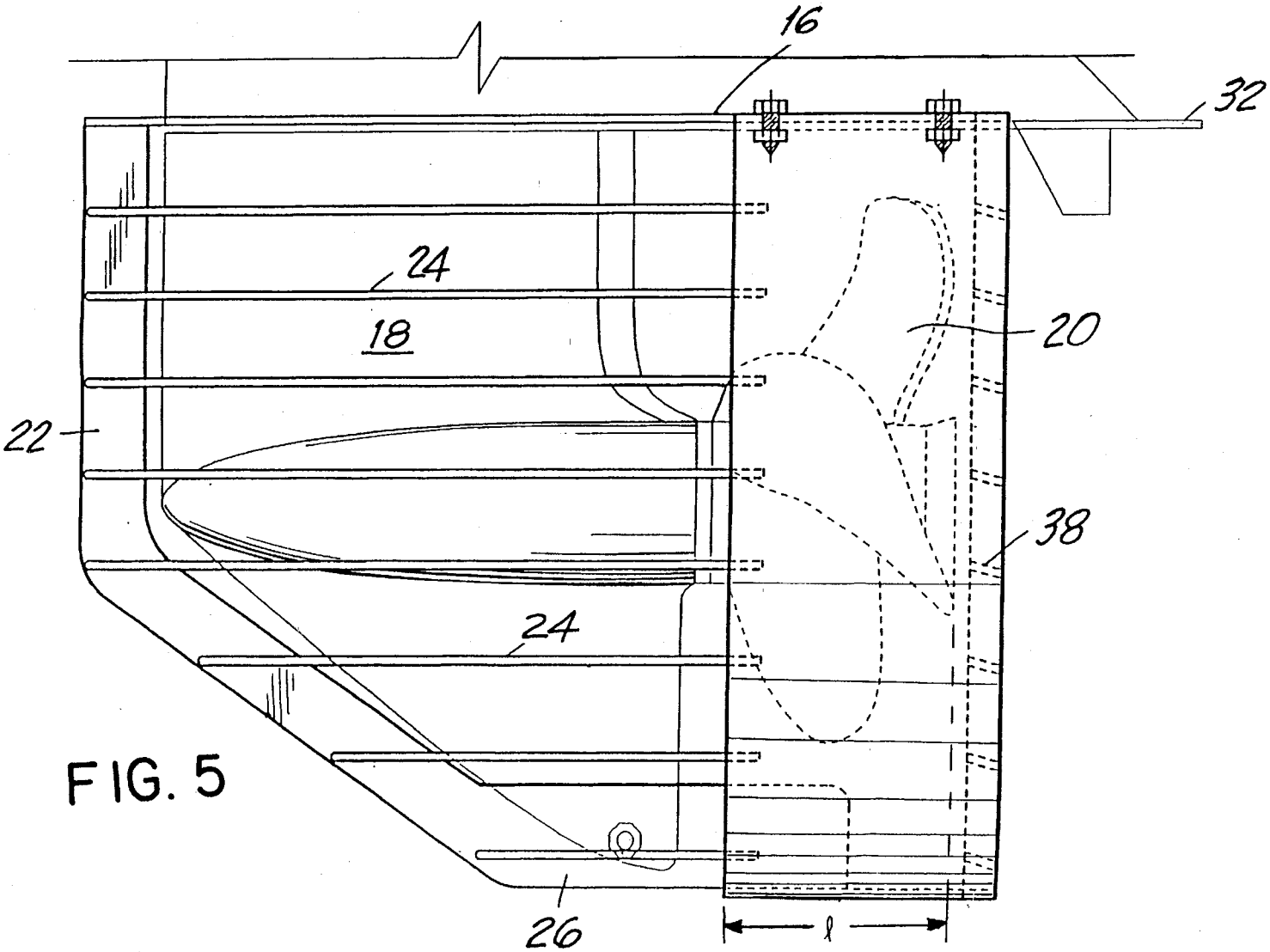
FIG. 5 is a side plan view of an embodiment of the present invention incorporating the propeller guard as illustrated in FIGS. 1 and 2 with the rear cover illustrated in FIGS. 4 and 5 attached thereto. In addition.
Figure 6:
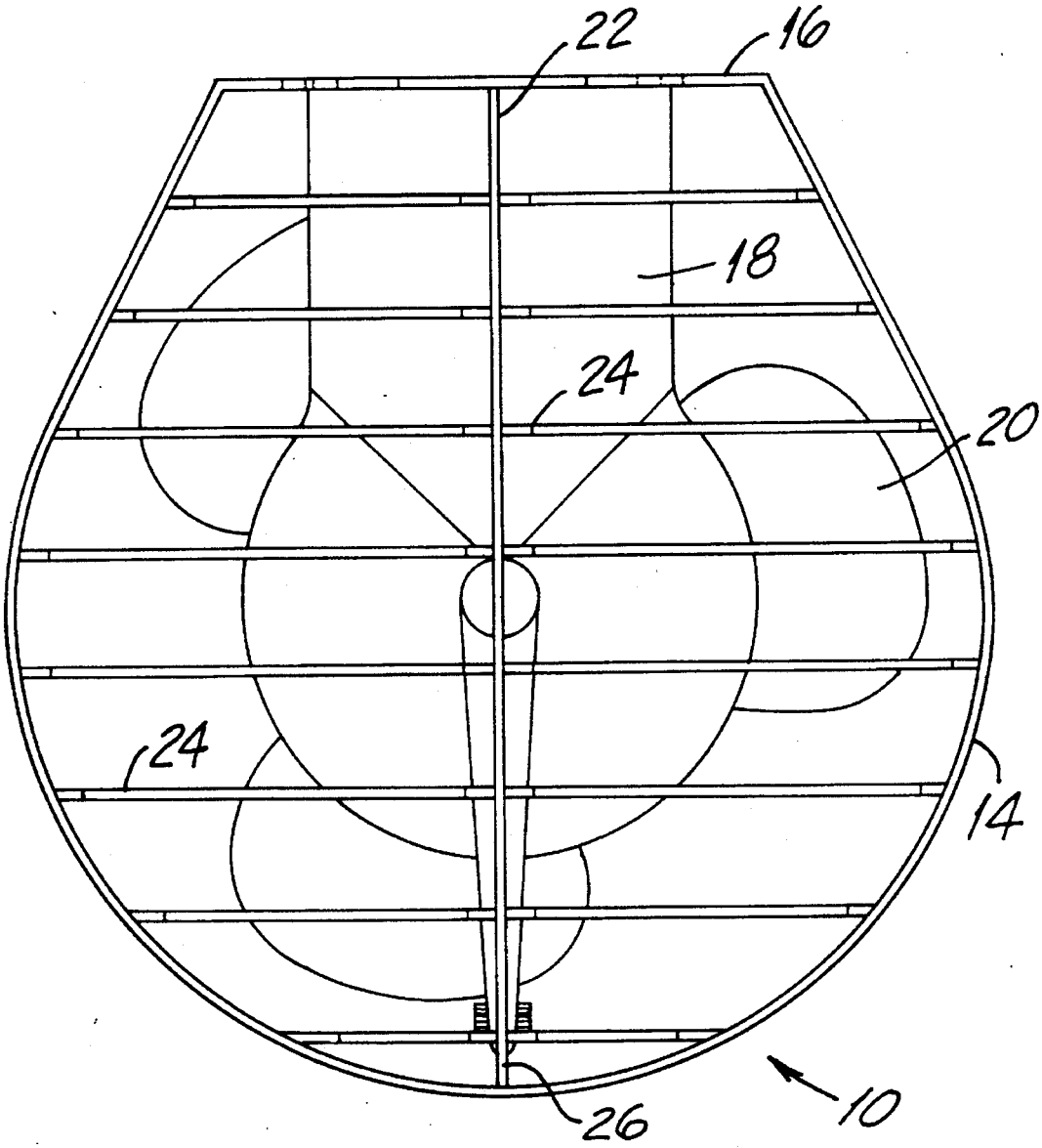
FIG. 6 is a plan view of the propeller enclosure and the rear cover illustrated in FIG. 5, as would be seen from the front of the watercraft looking toward the rear of the watercraft if the embodiment were mounted on a watercraft motor.
Figure 7:
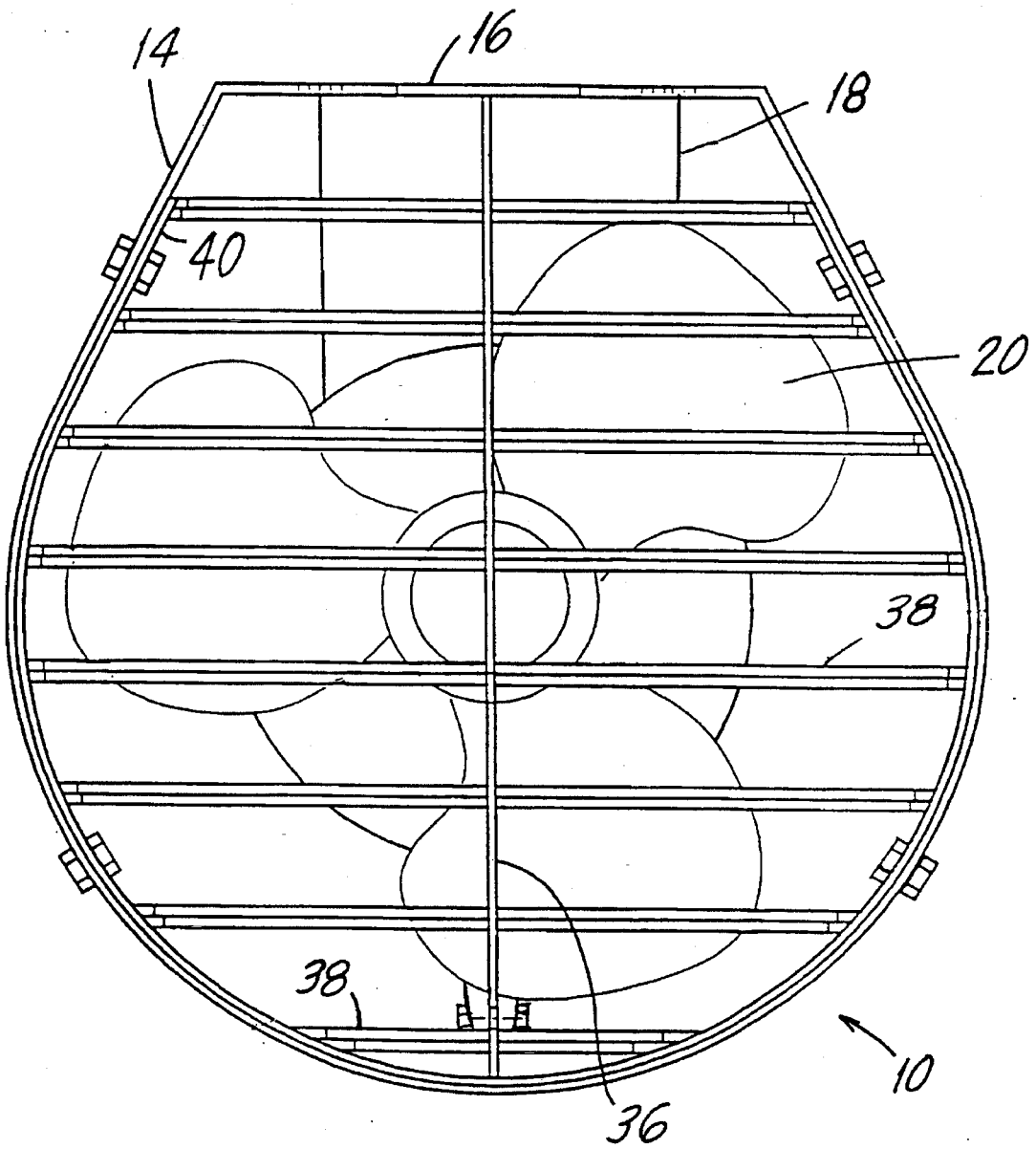
FIG. 7 is a plan view of the embodiment illustrated in FIG. 6 as seen from the rear of the watercraft looking toward the front of the watercraft if the embodiment were mounted on a watercraft motor.

Referring to FIGS. 1 through 7, a propeller enclosure 10 according to the present invention includes a fence portion 12 and a band portion 14. Fence portion 12 is connected to band portion 14. Both fence portion 12 and band portion 14 are connected to mounting bracket 16. Fence portion 12, band portion 14 and mounting bracket 16 define a cavity for receiving watercraft motor skeg 18 and propeller 20.

Fence portion 12 is hydro-dynamically constructed, having a central support rib 22 and a series of substantially parallel ribs 24. One end of ribs 24 is connected to central support rib 22 at the front most portion of propeller enclosure 10. The opposite ends of ribs 24 extend outwardly from the vertical plane defined by central support rib 22 and are connected to band portion 14 to complete the hydro-dynamic construction. Preferably, ribs 24 are welded to both central support rib 22 and band portion 14. Similarly, central support rib 22 is preferably welded to both mounting surface 16 and band portion 14. In one embodiment, ribs 24 are approximately 0.125 inches thick, approximately 0.25 inches wide, and have lengths ranging between approximately 4.375 inches to approximately 10.625 inches. In addition, adjacent ribs 24 have spaces therebetween of approximately 1.125 inches. This spacing creates open zones which allow the water to flow through fence portion 12.

Center support 22 includes strengthened bottom member 26 having connecting means 28 for connecting skeg 18 of a watercraft motor to propeller enclosure 10. Connecting means 28 may include an aperture for receiving a bolt for connecting the skeg to bottom member 26. Clamping to provide a ridge for receiving the edge of the skeg 18, or welding skeg 18 to bottom member 26 are alternatives to the bolt construction.

Mounting bracket 16 is constructed so as to include an opening for receiving skeg 18 of a watercraft motor. Mounting surface 16 also includes openings 30 for mounting propeller enclosure 10 to cavitation plate 32. Openings 30 may receive bolts to connect mounting surface 16 to cavitation plate 32. Alternatively, clips or screws or other means of fastening, including welding, may be employed.

Band portion 14 is sufficiently wide so as to extend the entire axial length l of propeller 20, including the individual propeller blades. Band portion 14 extends approximately 270° around propeller 20 forming a U-shaped support. In one embodiment, band portion 14 is approximately 12 inches in diameter having a width of approximately 4 inches and a height of approximately 11.625 inches. In addition, fence portion 12 extends approximately 10 inches axially from the edge of the band portion 14.

Band portion 14 primarily acts to prevent objects from coming into contact with propeller 20. Band portion 14 enhances motor thrust by providing a closed channel, through which propeller 20 moves water.

Fence portion 12 acts to support band portion 14 and to prevent the flow of undesired objects into contact with propeller 20. Moreover, the flared construction of fence portion 12 enhances the hydro-dynamic operation of propeller enclosure 10, thereby minimizing drag.

Mounting surface 16 stabilizes both fence portion 12 and band portion 14. Preferably, openings 30 are positioned adjacent to band portion 14 to provide significant stability thereto.

In addition, rear cover 34 is connected to band portion 14 to further protect individuals, animals and objects from contacting propeller 20. Rear cover 34 includes center support member 36, substantially horizontal slats 38, and outer frame 40. In one embodiment, slats 38 are approximately 0.125 inches thick, approximately 0.375 inches wide, and range from approximately 2.0 inches to approximately 5.25 inches in length. Slats 38 are spaced approximately 1.25 inches apart. In a preferred embodiment, horizontal slats 38 are disposed at an angle $\alpha$ of approximately 20° from the horizontal, facing away from mounting surface 16. When disposed at an angle, horizontal slats 38 act as a trim-tab-like device, thereby improving fuel efficiency of the motor to which propeller enclosure 10 is attached. Outer frame 40 of rear cover 34 is attached to band portion 14 using screws, bolts or clips. It is foreseeable that one may weld outer frame 40 of cover 34 to propeller enclosure 10 or provide a latch and hinge arrangement.

It is also conceivable that one may provide for rotation of horizontal slats 38 with respect to a horizontal axis. Rotation permits adjusting angle $\alpha$, and thus, the trim-tab-like action of horizontal slats 38. Movement of horizontal slats 38 may be effected by structures known in the art relating to louvres and trim-tab devices.

It is preferable that the spacing between both ribs 24 of fence portion 12 and horizontal slats 38 of rear cover 34 are sufficiently small enough to prevent contact of items of various sizes with the propeller, more specifically, fingers, larger stones, etc.

In one embodiment, it is preferable that the present invention be constructed from stainless steel.

What is claimed is:

1. A boat motor enclosure to provide both protection from a propeller and protection to the propeller comprising:

a mounting bracket, a fence portion extending down from and attached to said mounting bracket, said fence portion being dimensioned to encompass the skeg portion of an outboard motor, said fence portion having a set of spaced apart ribs to deflect large objects and to provide substantial open zones through which water can readily flow, said fence portion including at least one mounting rib attached to said mounting bracket, a substantially U-shaped band portion extending down from and attached to said mounting bracket, said band portion extending around the majority of the circumference of the propeller blades, said band portion having a substantially U-shaped forward edge which is attached to the rear of said fence portion, said band portion having a substantially U-shaped rear edge defining a rear opening and a surface connecting said front and rear edges, a cover mounted across said rear edge of said band portion, said cover having a plurality of spaced apart slats positioned over substantially all of the rear opening to prevent inadvertent contact between the propeller and objects and to allow passage of water therethrough and also angled to provide trim-tab like action to maintain the propeller under water, said fence portion, said band portion and said cover defining a space within which the skeg and propeller of the boat motor are containable, the surface of said band portion and the mounting plate providing substantially complete shielding of said propeller blades around the majority of the circumference of the propeller blades to improve motor.

2. The boat motor enclosure of claim 1 wherein:

said fence portion tapers inwardly from said rear thereof to a front end thereof, said mounting rib extending along said front end of said fence portion, each of said ribs of said fence portion extending from said mounting rib to said U-shaped forward edge of said band portion.

3. The boat motor enclosure of claim 1 wherein said spaced apart slats are at a downward angle, said angle being twenty degrees from a horizontal plane defined by the mounting bracket.

* * * * *